US007124664B1

(12) United States Patent
Lee

(10) Patent No.: US 7,124,664 B1
(45) Date of Patent: Oct. 24, 2006

(54) RATCHET WRENCH

(76) Inventor: Chang Chuan Lee, No. 429, Jhong Jheng Rd., Caotun Township, Nantou County (TW)

( * ) Notice: Subject to any disclaimer, the term of this patent is extended or adjusted under 35 U.S.C. 154(b) by 0 days.

(21) Appl. No.: 11/409,007

(22) Filed: Apr. 24, 2006

(51) Int. Cl.
*B25B 13/46* (2006.01)

(52) U.S. Cl. ..... 81/63.1; 81/61; 81/62; 81/63.2; 192/43.1

(58) Field of Classification Search ..... 81/60–63.2, 81/58, 58.4; 192/43.1
See application file for complete search history.

(56) References Cited

U.S. PATENT DOCUMENTS 6,282,993 B1 * 9/2001 Forman et al. ..... 81/63.2
6,691,594 B1 * 2/2004 Chen ..... 81/61
6,789,449 B1 * 9/2004 Liu ..... 81/63.2
6,886,428 B1 * 5/2005 Hsien ..... 81/63.2
6,981,434 B1 * 1/2006 Chen ..... 81/63.1

* cited by examiner

*Primary Examiner*—Lee D. Wilson
*Assistant Examiner*—Anthony Ojini

(57) ABSTRACT

A ratchet wrench including a head section formed with two slots and two pawls each having a post slidably fitted through the slots. The ratchet wrench further includes a shift member formed with two slots respectively intersecting the slots of the head section. The posts of the pawls are slidably inlaid in the slots of the head section and the slots of the shift member. By means of shifting the shift member, the pawls can be directly driven to slide along the slots, whereby one of the pawls is engaged with the ratchet wheel, while the other of the pawls is disengaged from the ratchet wheel.

10 Claims, 9 Drawing Sheets

RATCHET WRENCH

BACKGROUND OF THE INVENTION

The present invention is related to a ratchet wrench, and more particularly to a ratchet wrench having fewer components to lower manufacturing cost.

FIG. 9 shows a conventional ratchet wrench including a main body 7, a ratchet wheel 8, two pawls 81, a shift member 82 and a transmission member 83.

The main body 7 has a head section 71 formed with a receiving space 72 in which the ratchet wheel 8 is disposed. A cavity is formed at a front end of the handle of the main body 7 and communicates with the receiving space 72. The two pawls 81 are accommodated in the cavity. A spring 811 is compressed between the two pawls 81. Each pawl 81 has a boss 812.

The shift member 82 is arranged on a surface of the head section 71 of the main body 7. The shift member 82 has hub section 821. The hub section 821 is fitted through a through hole 73 formed on the surface of the head section 71. The transmission member 83 has a fitting column 831 fitted in the hub section 821. The transmission member 83 is formed with two connecting holes 832 in which the bosses 812 of the pawls 81 are respectively fitted. By means of shifting the shift member 82, the two pawls 81 can be driven and switched to selectively engage with the ratchet wheel 8 or disengage therefrom.

The conventional ratchet wrench includes numerous complicated components. It costs much time to manufacture and assemble these components so that the cost for the conventional ratchet wrench is relatively high. This makes the conventional ratchet wrench lack competitive ability on the market.

SUMMARY OF THE INVENTION

It is therefore a primary object of the present invention to provide a ratchet wrench having fewer simplified components to lower manufacturing cost.

According to the above object, the ratchet wrench of the present invention includes:

a main body having a handle and a head section connected with a front end of the handle, the head section being formed with a receiving space axially passing through the head section, a cavity being formed at the front end of the handle and communicating with the receiving space of the head section;

a ratchet wheel formed with ratchets and disposed in the receiving space of the main body;

a restricting member connected with the head section for preventing the ratchet wheel from dropping out of the receiving space of the head section;

two pawls disposed in the cavity, a post being connected with each pawl, the head section being formed with two slots respectively corresponding to the pawls, the posts of the pawls being slidably fitted through the slots, whereby the pawls can slide within the cavity along the slots, the pawls being formed with ratchets, a resilient member being compressed between the two pawls to abut against the two pawls;

a shift member arranged on the head section of the main body for driving the pawls to slide and making one of the pawls engaged with the ratchet wheel; and a frictional plate tightly sandwiched between the shift member and the head section, the frictional plate having a boss protruding toward the head section, the shift member having a connecting section drivingly connected with the frictional plate.

The present invention can be best understood through the following description and accompanying drawings wherein:

DETAILED DESCRIPTION OF THE PREFERRED EMBODIMENTS

Figure 1:
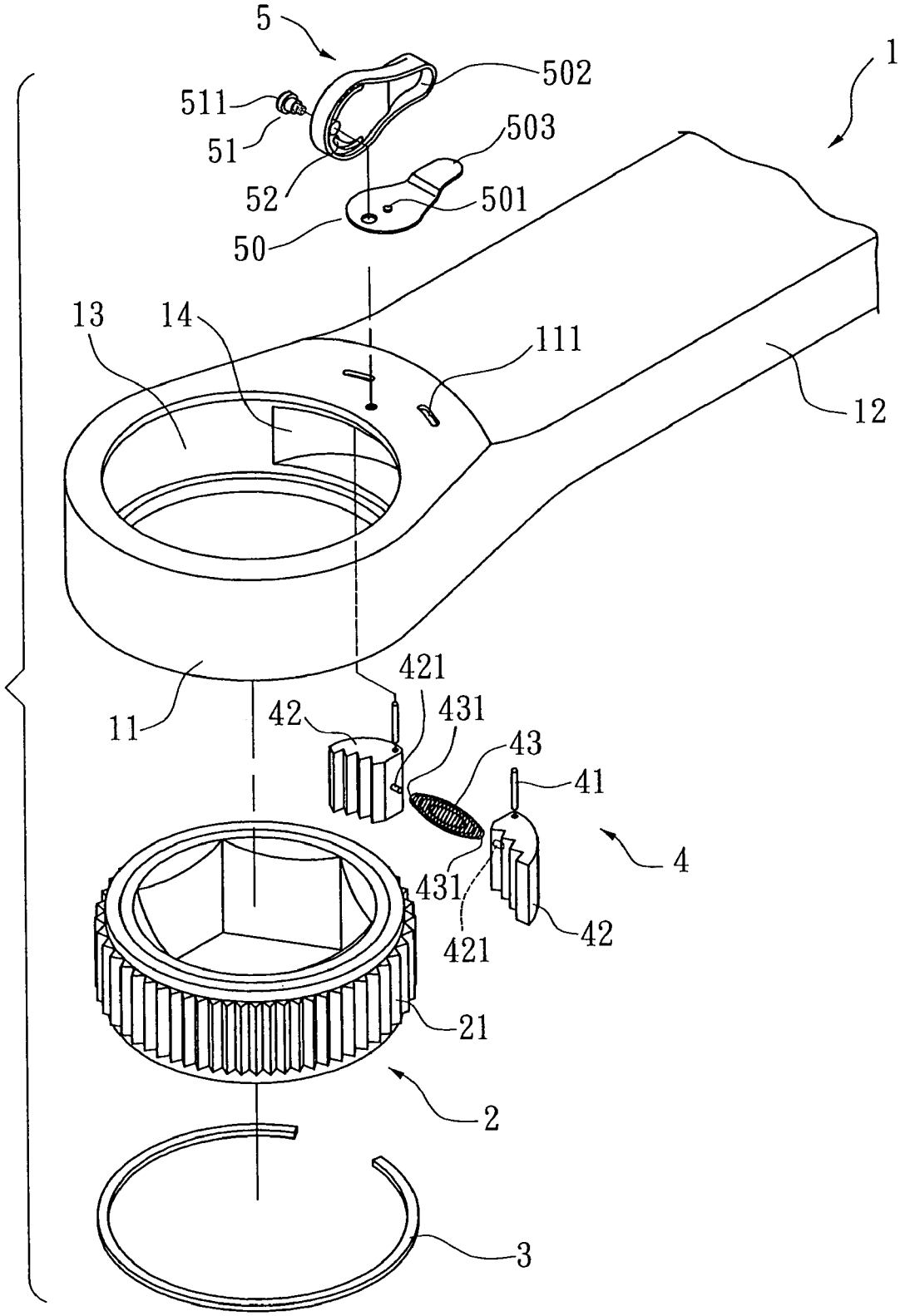
FIG. 1 is a perspective exploded view of a first embodiment of the present invention.
Figure 2:
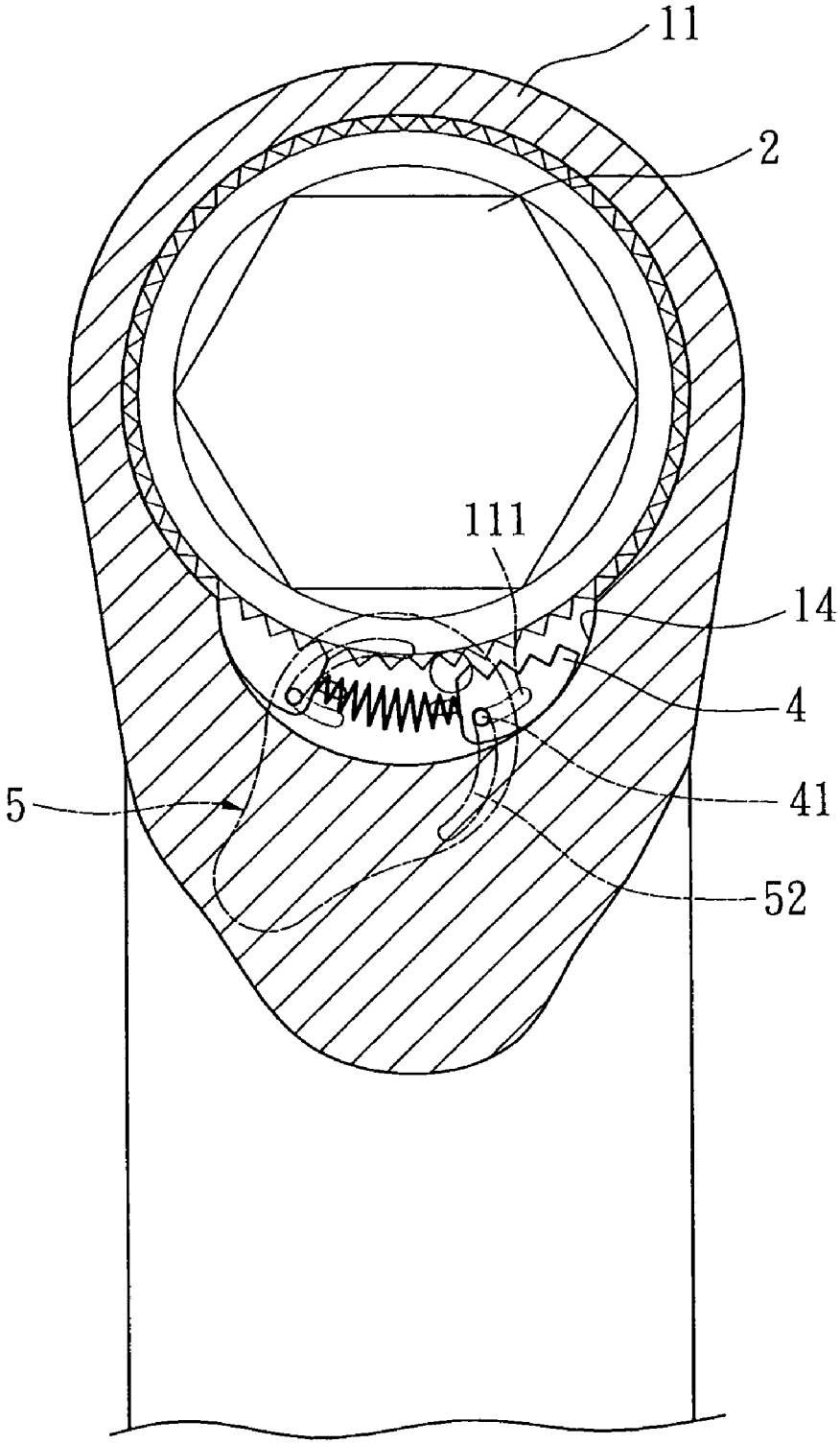
FIG. 2 is a sectional view of the first embodiment of the present invention.
Figure 3:
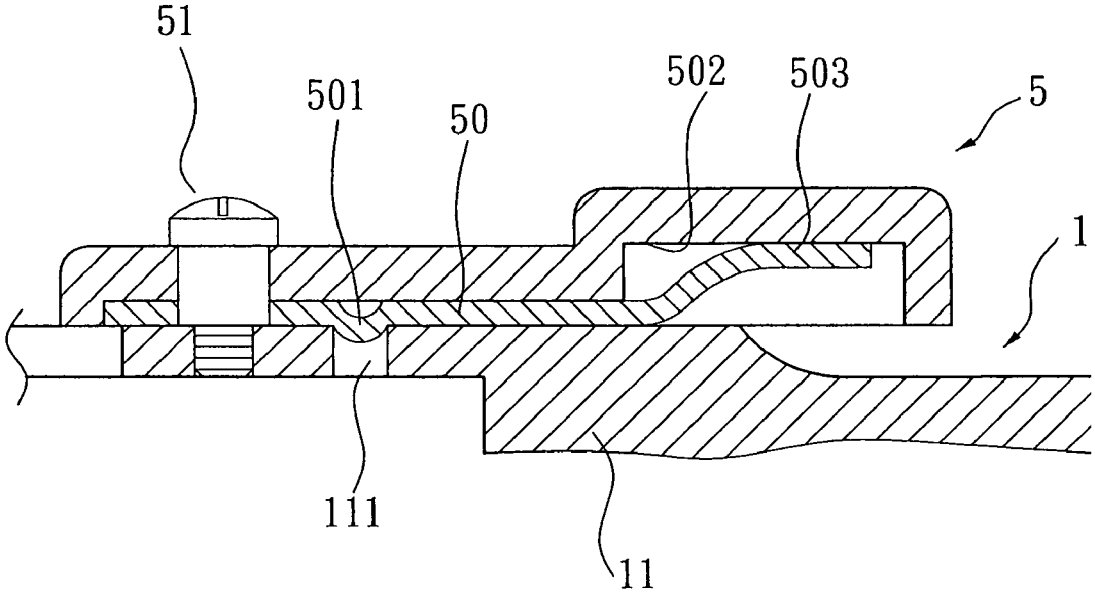
FIG. 3 is a sectional view of the first embodiment of the present invention, showing the frictional plate thereof.

Please refer to FIGS. 1 to 3. The ratchet wrench of the present invention includes a main body 1 having a handle 12 and a head section 11 connected with a front end of the handle 12. The head section 11 is formed with a receiving space 13 axially passing through the head section 11. A cavity 14 is formed at the front end of the handle 12 and communicates with the receiving space 13 of the head section 11.

The ratchet wrench of the present invention further includes a ratchet wheel 2 formed with ratchets 21 and disposed in the receiving space 13 of the main body 1.

The ratchet wrench of the present invention further includes a restricting member 3. In this embodiment, the restricting member is a C-shaped retainer ring inlaid in the head section 11 to prevent the ratchet wheel 2 from dropping out of the receiving space 13 of the head section 11.

The ratchet wrench of the present invention further includes two pawls 4 disposed in the cavity 14. A post 41 is connected with each pawl 4. The head section 11 is formed with two slots 111 respectively corresponding to the pawls 4. The posts 41 of the pawls 4 are slidably fitted through the slots 111, whereby the pawls 4 can slide within the cavity 14 along the slots 111. The pawls 4 are formed with ratchets 42.

The ratchet wrench of the present invention further includes a shift member 5 arranged on the head section 11 of the main body 1 for driving the pawls 4 to slide and making one of the pawls 4 engaged with the ratchet wheel 2. A resilient member 43 is compressed between the two pawls 4. In this embodiment, the resilient member 43 is a coiled spring 43. Two ends of the spring 43 are respectively formed with two fitting holes 431 in which two connecting studs 421 of the pawls 42 are inserted. The two ends of the spring 43 respectively abut against the two pawls 4.

The ratchet wrench of the present invention further includes a frictional plate 50 tightly sandwiched between the shift member 5 and the head section 11. The frictional plate 50 has a boss 501 protruding toward the head section 11. The boss 501 is selectively inlaid in one of the two slots 111. The shift member 5 has a connecting section 502 drivingly connected with the frictional plate 50. In this embodiment, the connecting section 502 is a recess in which the frictional plate 50 is accommodated. The frictional plate 50 has a tongue section 503 bent toward the recess.

The ratchet wrench of the present invention further includes a pivot member 51 screwed in the head section 11 of the main body 1. The pivot member 51 extends through the shift member 5 and the frictional plate 50. The pivot member 51 has an enlarged head section 511 for pressing the shift member 5, whereby the shift member 5 is pivotally connected with the head section 11. The wall of the slot 111 exerts a frictional force onto the boss 501 of the frictional plate 50 so as to locate the same.

The posts 41 of the pawls 4 protrude from the slots 111. The shift member 5 is formed with two slots 52 respectively intersecting the slots 111 of the head section 11. The posts 41 are slidably inlaid in the slots 52.

In use, a user can shift and pivotally swing the shift member 5 to one side as shown in FIGS. 2 and 3. At this time, the posts 41 of the pawls 4 are guided by the slots 111 of the head section 11 and the slots 52 of the shift member 5 to slide along the slots 111 and 52, whereby one of the pawls 4 is engaged with the ratchet wheel 2.

According to the above arrangement, the shift member 5 can directly drive the two pawls 4 to slide. The number of the components of the ratchet wrench of the present invention is reduced and the structures of the components are simplified.

Figure 4:
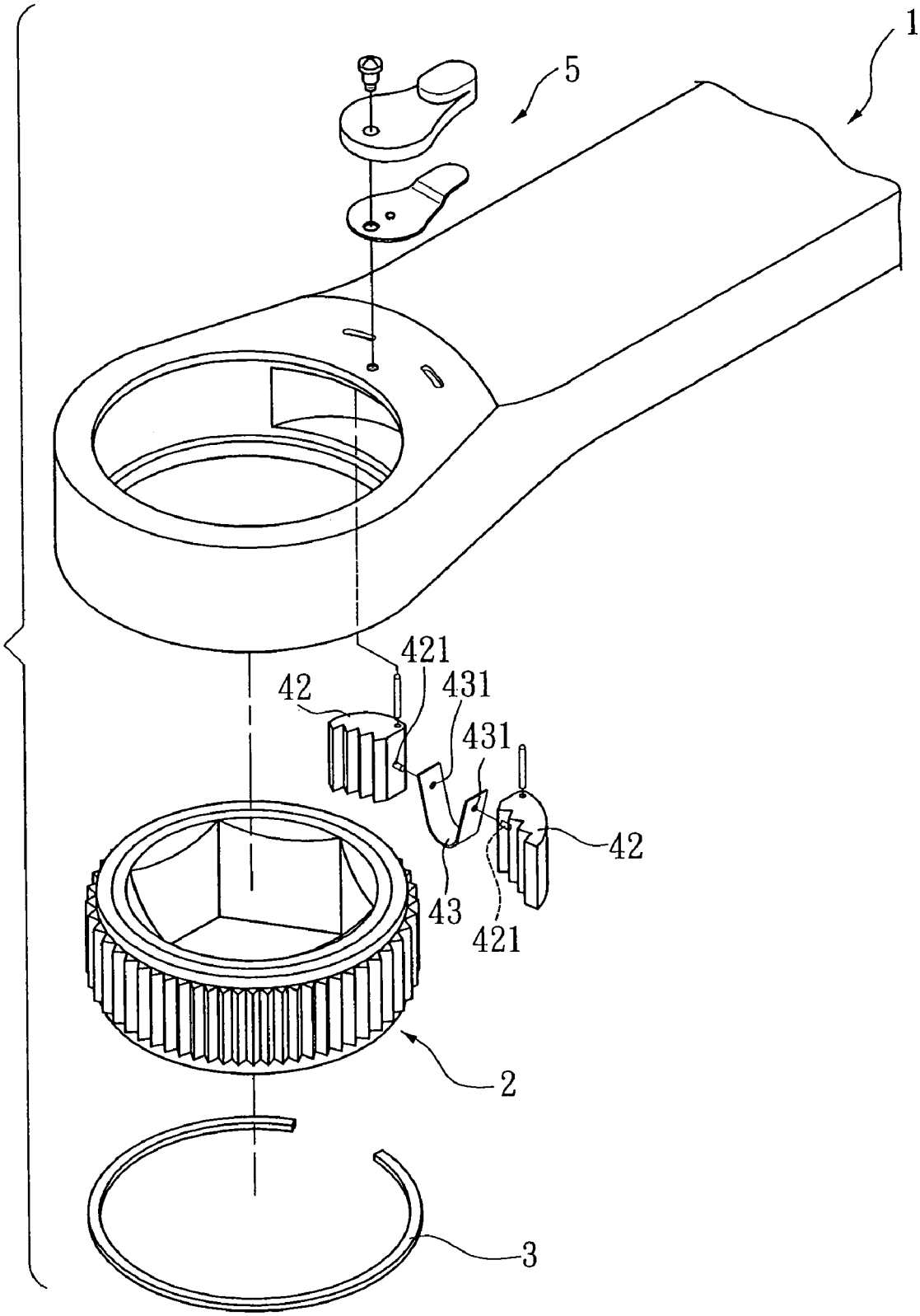
FIG. 4 is a perspective exploded view of a second embodiment of the present invention.

FIG. 4 shows a second embodiment of the present invention, in which the resilient member 43 is a U-shaped leaf spring. Two ends of the leaf spring 43 are formed with fitting holes 431 in which the connecting studs of the pawls are inserted.

Figure 5:
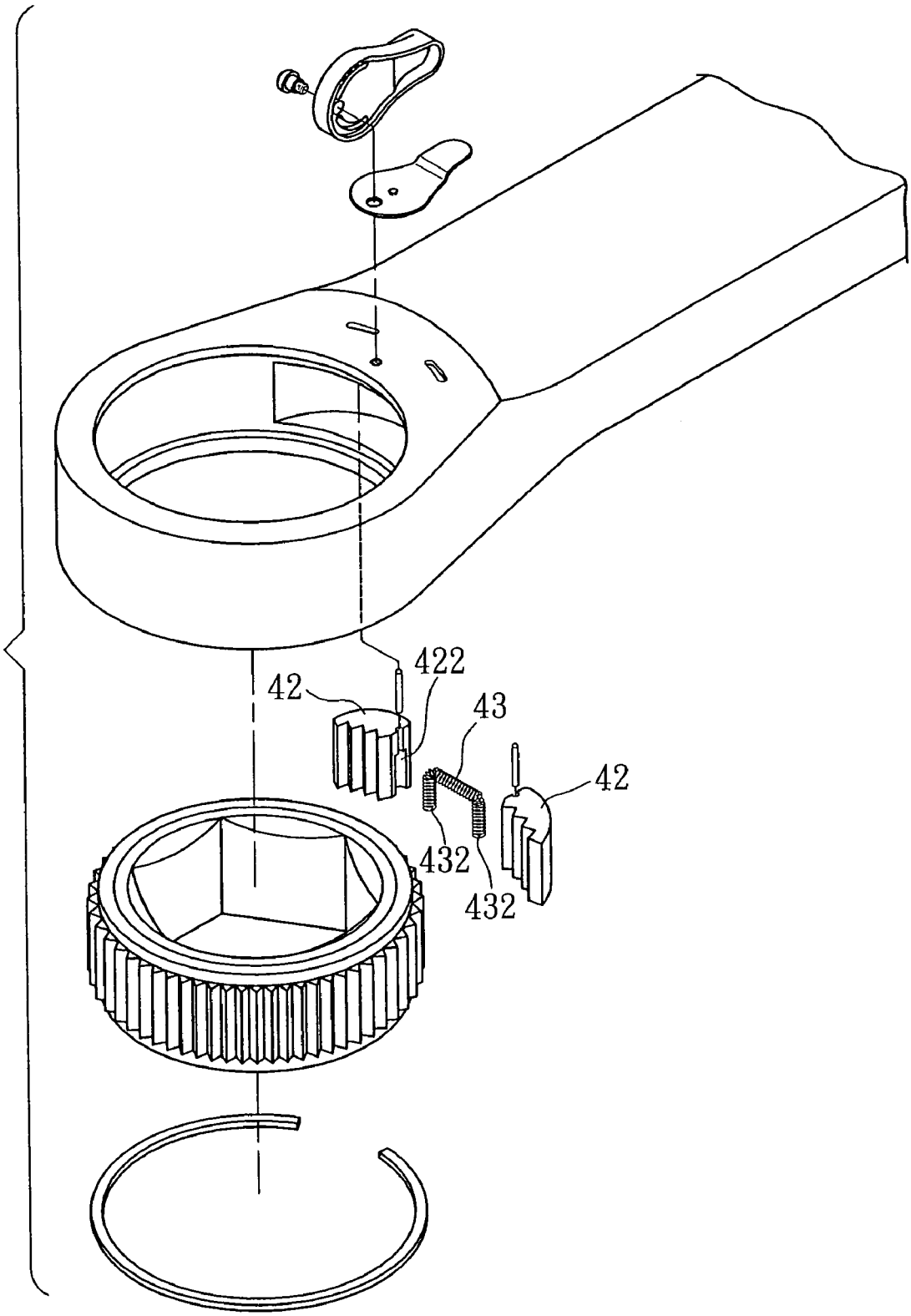
FIG. 5 is a perspective exploded view of a third embodiment of the present invention.

FIG. 5 shows a third embodiment of the present invention, in which the two pawls 4 are formed with opposite receptacles 422. The resilient member 43 is a U-shaped spring having two support arms 432 at two ends. The support arms 432 are respectively inlaid and located in the receptacles 422 of the pawls 4.

Figure 6:
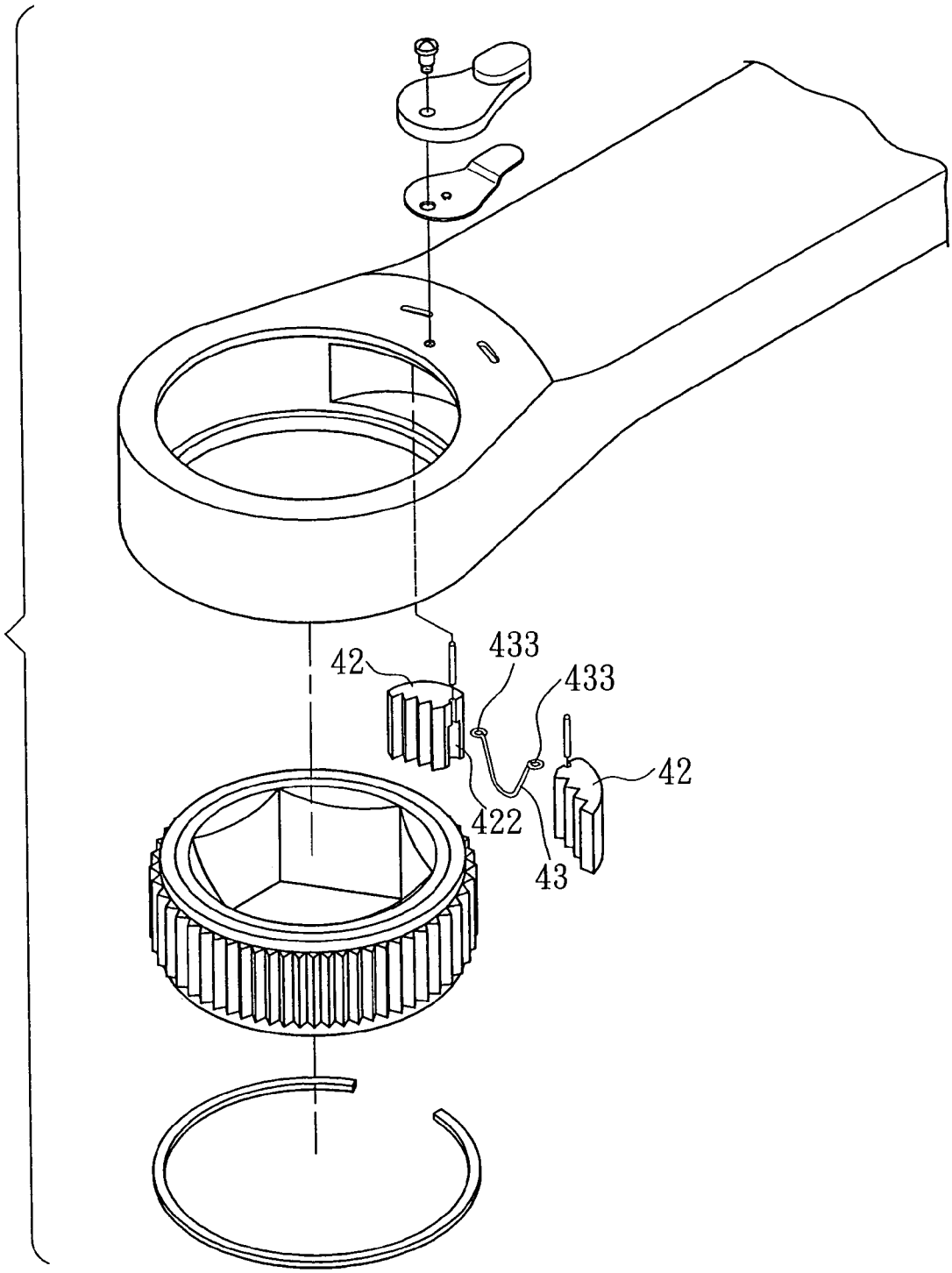
FIG. 6 is a perspective exploded view of a fourth embodiment of the present invention.

FIG. 6 shows a fourth embodiment of the present invention, in which the resilient member 43 is a U-shaped metal wire. Two ends of the metal wire are curled to form two abutting sections 433 inlaid and located in the receptacles 422 of the pawls 4.

Figure 7:
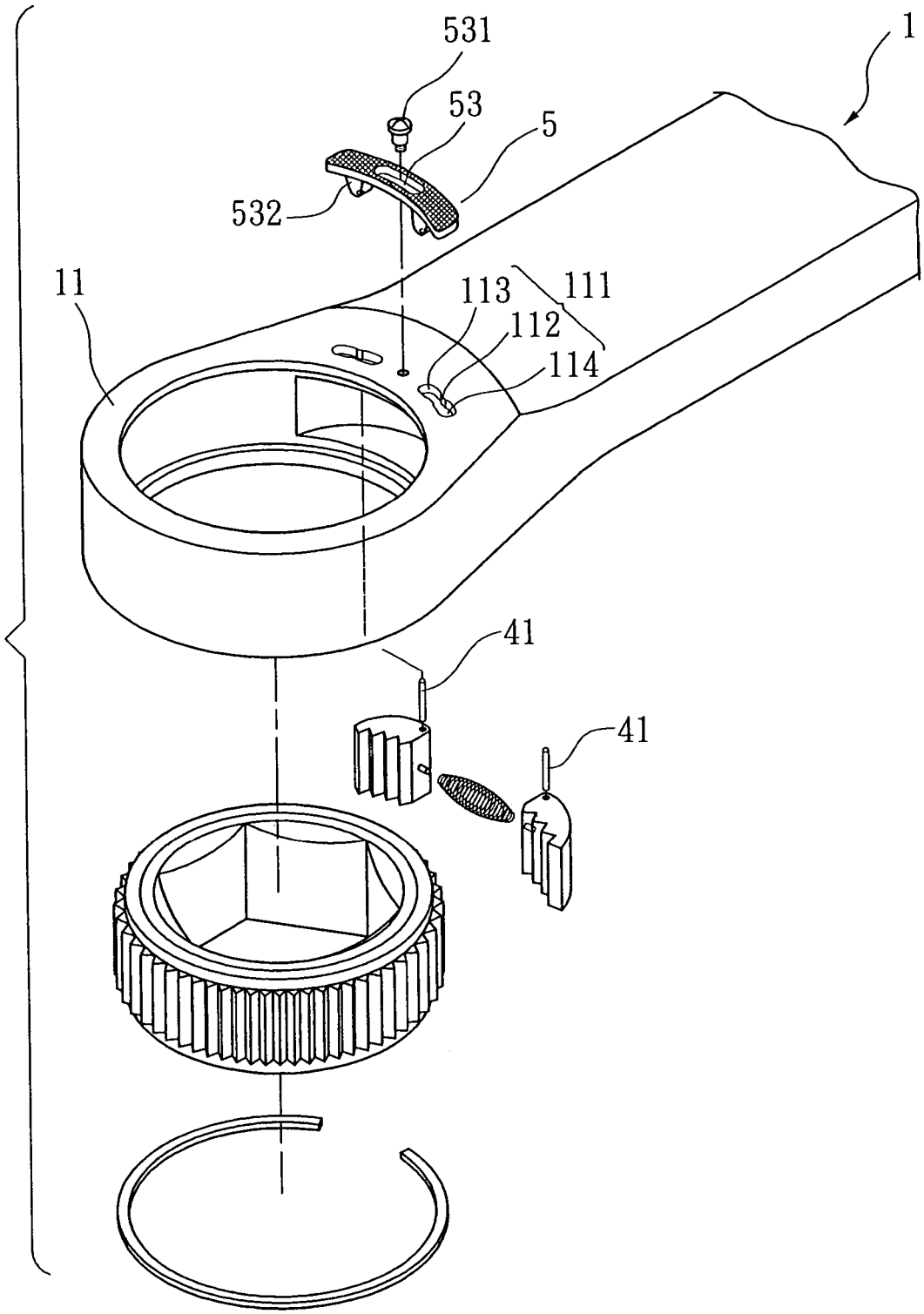
FIG. 7 is a perspective exploded view of a fifth embodiment of the present invention.
Figure 8:
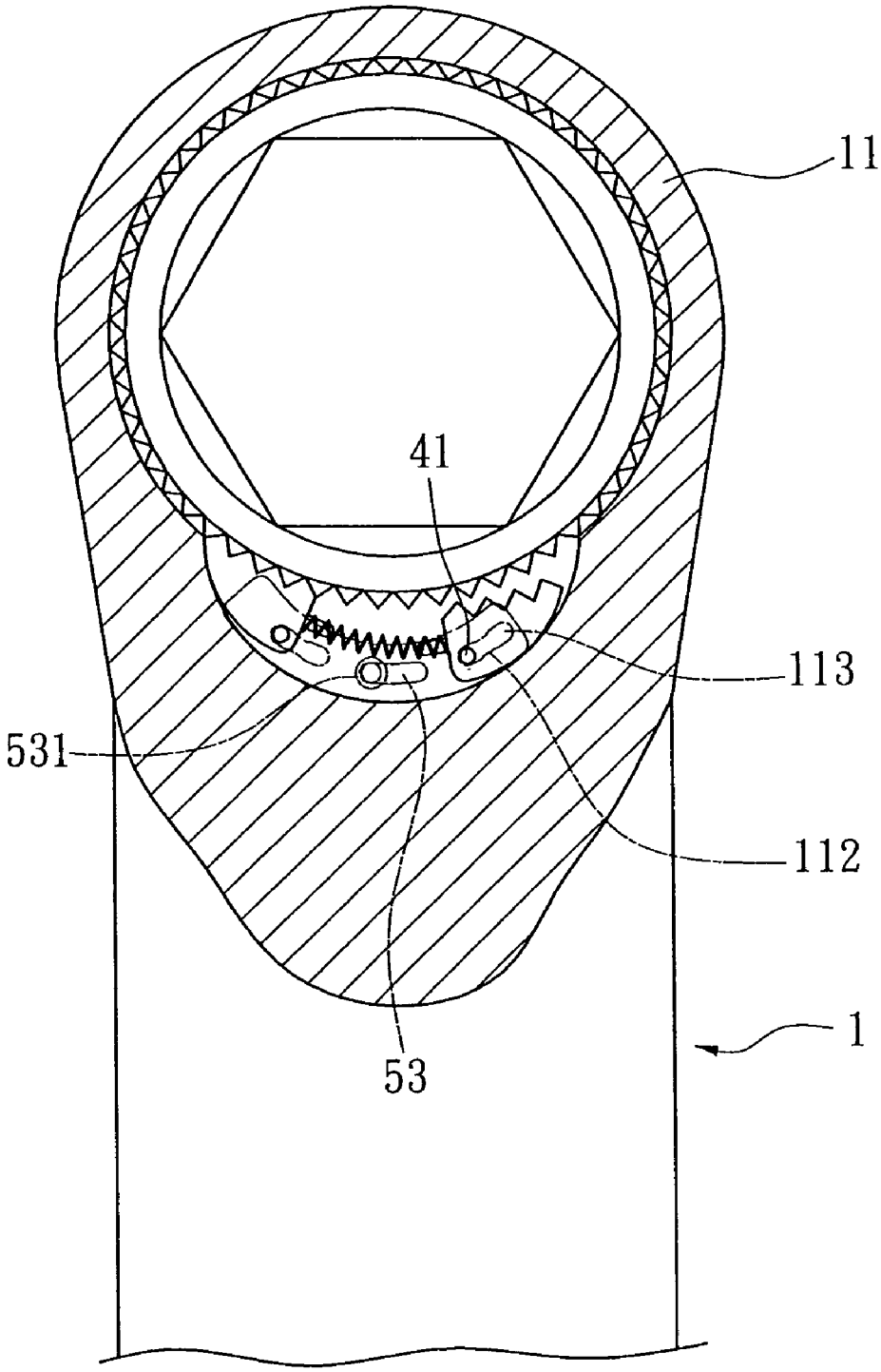
FIG. 8 is a sectional view of the fifth embodiment of the present invention.
Figure 9:
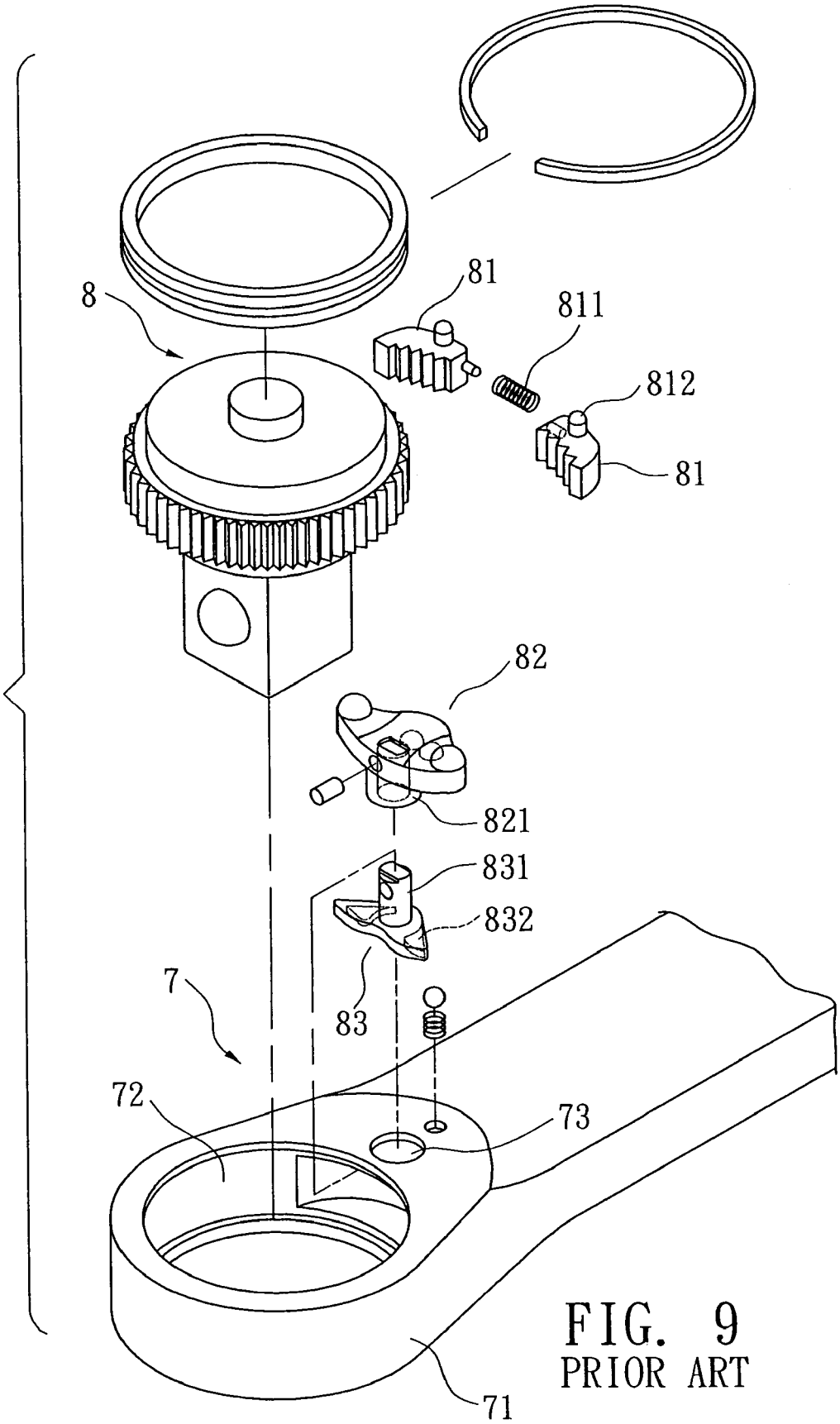
FIG. 9 PRIOR ART
FIG. 9 is a perspective exploded view of a conventional ratchet wrench.

FIGS. 7 and 8 show a fifth embodiment of the present invention, in which a middle section of each of the slots 111 is formed with a neck section 112 with smaller width. The shift member 5 is formed with a slot 53. A fixing member 531 is fitted through the slot 53 to connect with the head section 11 of the main body 1 and prevent the shift member 5 from detaching from the head section 11. Two connecting seats 532 respectively project from two sides of the slot 53 of the shift member 5. The posts 41 of the pawls are fitted with the connecting seats 532.

The neck section 112 divides the slot 111 into a first locating section 113 and a second locating section 114. When a user shifts the shift member 5, via the posts 41 of the pawls 4, the pawls 4 are driven and slid to locate in the first locating section 113 or the second locating section 114.

In conclusion, the shift member of the present invention can be directly shifted to drive the two pawls 4 so as to switch the wrenching directions of the ratchet wrench. The number of the components of the ratchet wrench of the present invention is reduced and the structures of the components are simplified. Therefore, the manufacturing cost of the ratchet wrench is lowered.

The above embodiments are only used to illustrate the present invention, not intended to limit the scope thereof. Many modifications of the above embodiments can be made without departing from the spirit of the present invention.

What is claimed is:

1. A ratchet wrench comprising:

a main body having a handle and a head section connected with a front end of the handle, the head section being formed with a receiving space axially passing through the head section, a cavity being formed at the front end of the handle and communicating with the receiving space of the head section;

a ratchet wheel formed with ratchets and disposed in the receiving space of the main body;

a restricting member connected with the head section for preventing the ratchet wheel from dropping out of the receiving space of the head section;

two pawls disposed in the cavity, a post being connected with each pawl, the head section being formed with two slots respectively corresponding to the pawls, the posts of the pawls being slidably fitted through the slots, whereby the pawls can slide within the cavity along the slots, the pawls being formed with ratchets, a resilient member being compressed between the two pawls to abut against the two pawls;

a shift member arranged on the head section of the main body for driving the pawls to slide and making one of the pawls engaged with the ratchet wheel; and a frictional plate tightly sandwiched between the shift member and the head section, the frictional plate having a boss protruding toward the head section, the shift member having a connecting section drivingly connected with the frictional plate.

2. The ratchet wrench as claimed in claim 1, wherein the posts of the pawls protrude from the slots of the head section, the shift member being formed with two slots respectively intersecting the slots of the head section, the posts of the pawls being slidably inlaid in the slots of the head section and the slots of the shift member.

3. The ratchet wrench as claimed in claim 1, wherein a middle section of each of the slots is formed with a neck section with smaller width, the shift member being formed with a slot, a fixing member being fitted through the slot of the shift member to connect with the head section of the main body and prevent the shift member from detaching from the head section, two connecting seats respectively projecting from two sides of the slot of the shift member, the posts of the pawls being fitted with the connecting seats.

4. The ratchet wrench as claimed in claim 1, wherein the connecting section of the shift member is a recess in which the frictional plate is accommodated, the frictional plate having a tongue section bent toward the recess.

5. The ratchet wrench as claimed in claim 1, wherein the two pawls are respectively formed with two connecting studs opposite to each other, the connecting studs being respectively inserted in two ends of the resilient member to locate the resilient member.

6. The ratchet wrench as claimed in claim 5, wherein the resilient member is a coiled spring, two ends of the spring being respectively formed with two fitting holes in which the two connecting studs of the pawls are inserted.

7. The ratchet wrench as claimed in claim 5, wherein the resilient member is a U-shaped leaf spring, two ends of the leaf spring being formed with fitting holes in which the connecting studs of the pawls are inserted.

8. The ratchet wrench as claimed in claim 5, wherein the two pawls are respectively formed with two opposite receptacles, two ends of the resilient member being respectively inlaid and located in the receptacles of the pawls.

9. The ratchet wrench as claimed in claim 8, wherein the resilient member is a U-shaped spring having two support arms at two ends, the support arms being respectively inlaid and located in the receptacles of the pawls.

10. The ratchet wrench as claimed in claim 8, wherein the resilient member is a U-shaped metal wire, two ends of the metal wire being curled to form two abutting sections inlaid and located in the receptacles of the pawls.

* * * * *